United States Patent [19]

Herfeld

[11] Patent Number: 4,676,658

[45] Date of Patent: Jun. 30, 1987

[54] MIXING APPARATUS

[76] Inventor: F. W. Herfeld, Sall 7, 5982 Neuenrade, Fed. Rep. of Germany

[21] Appl. No.: 769,180

[22] Filed: Aug. 26, 1985

[30] Foreign Application Priority Data

Sep. 13, 1984 [DE] Fed. Rep. of Germany ..... 3433674

[51] Int. Cl.[4] ..... B01F 7/16

[52] U.S. Cl. ..... 366/197; 366/65; 366/200; 366/213; 366/222; 366/249; 366/252

[58] Field of Search ..... 366/64, 65, 184, 185, 366/189, 210, 211, 194–196, 197, 200, 199, 205, 206, 213, 242, 222, 224, 247–254, 279, 314, 349, 601

[56] References Cited

U.S. PATENT DOCUMENTS

| | | | |
|---|---|---|---|
| 2,652,983 | 9/1953 | Hall | 366/224 X |
| 4,135,828 | 1/1979 | Cabak | 366/197 |
| 4,432,650 | 2/1984 | Langen et al. | 366/601 |

FOREIGN PATENT DOCUMENTS 2110047 1/1983 Fed. Rep. of Germany .

*Primary Examiner*—Timothy F. Simone
*Attorney, Agent, or Firm*—Learman & McCulloch

[57] ABSTRACT

Mixing apparatus having a mixing vessel which is pivotable by 180° about a horizontal axis and has a stationary stirrer drive motor. Such mixing apparatus is distinguished by a simple construction. Furthermore, the speed of rotation of the stirrer shaft can be optimally adapted to the mixing process by means of reduction gears between the stationary drive motor and the stirrer.

6 Claims, 2 Drawing Figures

MIXING APPARATUS

Figure 1:
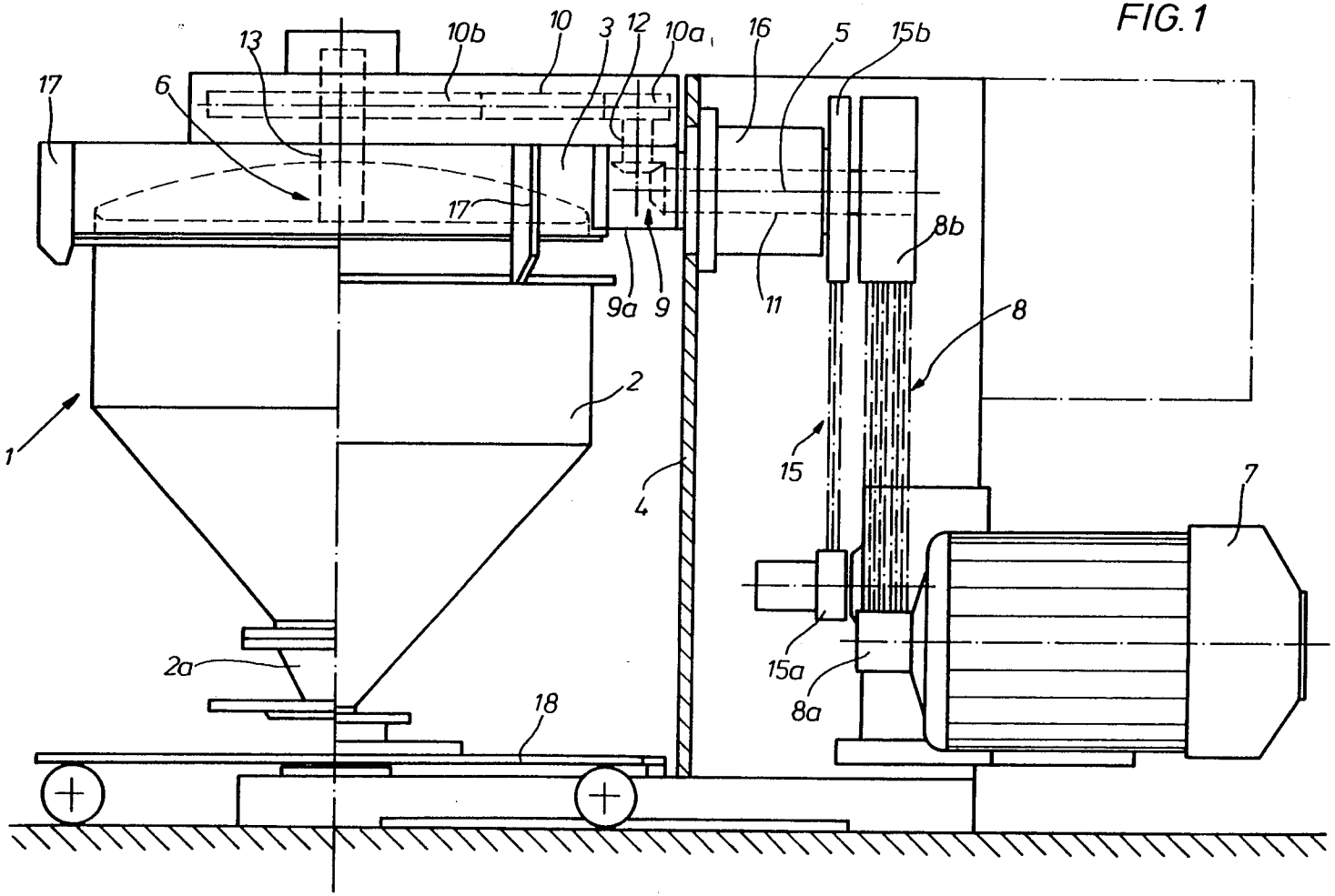

The invention relates to mixing apparatus having a mixing vessel composed of an upper part and a lower part movable between separated and closed positions and rotatable about a horizontal axis.

BACKGROUND OF THE INVENTION

Mixing apparatus of the general type disclosed herein is known from German Patent Specification No. 21 10 047. Since in this mixing apparatus the stirrer is located in the second vessel part which is pivotally mounted on the stationary support, the first vessel part, which is constructed so as to be transportable, can be brought below the second vessel part without any significant relative vertical movement and connected thereto. Because of the absence of a large relative vertical movement between the transportable first vessel part and the second vessel part containing the stirrer, not only is the expenditure on plant reduced but also the operation of the mixing apparatus is simplified.

Since the mixing vessel and the stirrer are then pivoted out of the starting position by 180° into a mixing position in which the second vessel part forms the base of the mixing vessel, the stirrer is then located right at the bottom of the mixing vessel. In this way a complete intermixing is ensured, even with material which is difficult to mix.

In the mixing apparatus according to German Patent Specification No. 21 10 047 the drive motor for the stirrer is arranged in axial extension of the stirrer on the outer surface of the second vessel part. The drive motor is therefore pivoted together with the second vessel part on transition from the starting position to the mixing position (and vice versa).

The object of the invention is to provide a simplified mixing apparatus of the type described.

SUMMARY OF THE INVENTION

Mixing apparatus according to the invention comprises vertically spaced first and second mixing vessels rotatable about a horizontal axis relative to a stationary support. The apparatus includes a drive motor for the stirrer which is mounted on the stationary support. The mounting of the stirrer drive motor on the stationary support is favourable above all in the case of high drive powers. The stationary stirrer drive motor does not need to carry out the pivot movement with the mixing vessel, and this reduces the torque necessary for the pivot movement and permits a lighter construction of the pivot mounting.

The mounting of the stirrer drive motor on the stationary stand of the mixing apparatus also results in a very desirable lower position of the centre of gravity. It is also advantageous that the horizontal axis about which the mixing vessel is pivotable can be positioned lower—about half-way up the mixing vessel—since for the pivotal movability of the second vessel part it is merely necessary to take account of the overall axial length of the stirrer (but not the overall axial length of the drive motor as well).

The mounting of the stirrer drive motor on the stationary stand also makes it possible to arrange a reduction gear both between the drive motor and the mitre gear and between the mitre gear and the stirrer. In this way the speed of the stirrer can be optimally adapted to the mixing operation, which is not possible in the case of a direct drive with fixed speed.

THE DRAWINGS

Figure 2:
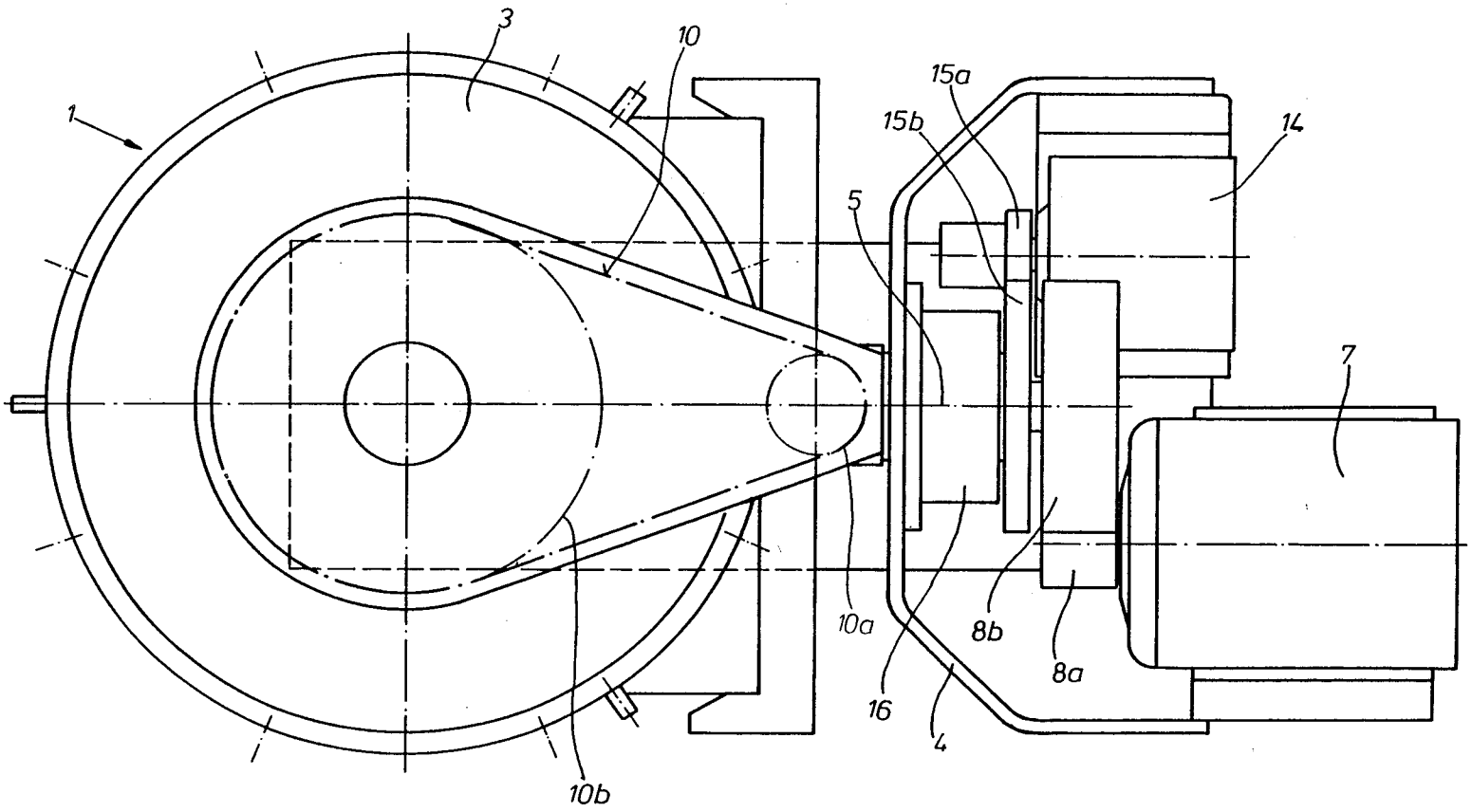

A preferred embodiment of the invention is illustrated in the drawings, in which:

FIG. 1 shows a side view of the mixing apparatus according to the invention, FIG. 2 shows a plan view of the mixing apparatus.

THE PREFERRED EMBODIMENT

The mixing apparatus shown in the drawings comprises a mixing vessel 1 which consists of two cup-like vessel parts 2 and 3 which can be connected to each other, of which the first vessel part 2 is constructed so as to be transportable and in the illustrated embodiment is provided with a base outlet 2*a*.

The second vessel part 3 is mounted on a stationary support 4 in such a way that it is pivotable by 180° about a horizontal axis 5. In a starting position which is shown in the left-hand half in FIG. 1 the second vessel part 3 forms the cover of the mixing vessel 1. In a mixing position which is rotated by 180° with respect to this starting position the vessel part 3 forms the base of the mixing vessel 1.

A stirrer 6 which is driven by a stirrer drive motor 7 is mounted in the second vessel part 3. The drive motor 7 is mounted on the stationary support 4 at a level below that of the axis 5.

The drive transmission between the drive motor 7 and the stirrer stirrer 6 comprises a speed reduction gear 8, a mitre gear 9 and a further speed reduction gear 10. The housing 9*a* of the mitre gear 9 is pivotable conjointly with the second vessel part 3 about the axis 5. The input shaft 11 of the mitre gear 9 is coaxial with the axis 5 about which the second vessel part 3 is pivotable. The output shaft 12 of the mitre gear 9 lies parallel to the stirrer shaft 13.

The pivotal movement of the mixing vessel 1 about the horizontal axis 5 is achieved by means of a driving motor 14 via a reduction drive transmission gear 15. The bearing provided on the support 4 for the pivot movement of the mixing vessel 1 is designated by 16.

The reduction gears 8, 10 and 15 are constructed for example as belt or chain drives. The belt pulleys or chain sprocket wheels of these three reduction gears are designated by 8*a*, 8*b*, 10*a*, 10*b*, and 15*a*, 15*b*. The two vessel parts 2 and 3 of the mixing vessel 1 are separably connected to each other by clamping means 17. The left-hand half of FIG. 1 shows the two vessel parts 2 and 3 in the position where they are clamped to each other, whilst the right-hand half of the drawing shows the vessel part 2 in the separated lowered position (resting on a transport wagon 18).

In operation the transportable vessel part 2 is moved under the vessel part 3 which is pivotally mounted on the support 4, raised slighly by a lifting device and clamped to the vessel part 3 to form with the latter or mixing chamber. Then the mixing vessel 1 is pivoted by the driving motor 14 by 180° into the mixing position so that the vessel part 3 forms with the stirrer 6 the bottom or base of the mixing chamber. Next the stirrer drive motor 7 is switched on and the mixing process is carried out. Then the mixing vessel 1 is pivoted by 180° back into the starting position and the vessel part 2 with the mixed material is removed.

As a variant of the manner of operation described above, the mixing apparatus according to the invention can also in case of need be used as a free-fall mixer. In this case the mixing vessel 1 is continuously pivoted by the drive motor 14 in a constant direction of rotation by more than 360° about the horizontal axis 5. The stirrer drive motor 7 for the stirrer can in this case be stationary or rotate disengaged.

I claim:

1. In mixing apparatus having a stationary stand on which a first mixing vessel part is mounted for rotation relative to said stand about a horizontal first axis, a stirrer having a shaft rotatably supported in said first vessel part for rotation about a second axis normal to said first axis, a second vessel part movable into clamping engagement with said first part to form with the latter a mixing chamber in which said first part forms a cover for said chamber, driving means, and transmission means interconnecting said driving means and said first part for rotating said first part about said horizontal first axis through at least 180° to an adjusted position in which said first part forms the bottom of said chamber, the improvement comprising stirrer shaft drive means mounted on said stationary stand; and drive transmitting means coupling said drive means and said stirrer shaft for rotating the latter in said adjusted position of said first part, said drive transmitting means including a drive shaft coaxial with said horizontal first axis, and gear means drivingly coupling said drive shaft to said stirrer shaft.

2. Mixing apparatus according to claim 1 wherein said gear means comprises mitre gears.

3. Mixing apparatus according to claim 1 wherein said drive transmitting means comprises speed reduction means.

4. Mixing apparatus according to claim 3 wherein said speed reduction means comprises meshing mitre gears.

5. Mixing apparatus according to claim 1 wherein said first vessel part is rotatable about said horizontal axis through at least 360°.

6. Mixing apparatus according to claim 5 wherein said driving means is operable to rotate said first vessel part continuously.

* * * * *